US011788383B2

(12) United States Patent
Schindler

(10) Patent No.: US 11,788,383 B2
(45) Date of Patent: Oct. 17, 2023

(54) APPARATUS AND METHOD FOR REMOVING DEBRIS FROM A WELLBORE

(71) Applicant: KLX Energy Services LLC, Houston, TX (US)

(72) Inventor: Kyle Steven Schindler, Williston, ND (US)

(73) Assignee: KLX Energy Services LLC, Houston, TX (US)

( * ) Notice: Subject to any disclaimer, the term of this patent is extended or adjusted under 35 U.S.C. 154(b) by 202 days.

(21) Appl. No.: 16/591,076

(22) Filed: Oct. 2, 2019

(65) Prior Publication Data

US 2020/0102809 A1 Apr. 2, 2020

Related U.S. Application Data

(60) Provisional application No. 62/740,031, filed on Oct. 2, 2018.

(51) Int. Cl.

| | |
|---|---|
| ***E21B 37/00*** | (2006.01) |
| ***E21B 10/00*** | (2006.01) |
| ***E21B 43/12*** | (2006.01) |
| ***E21B 43/08*** | (2006.01) |
| ***E21B 21/00*** | (2006.01) |

(52) U.S. Cl.

CPC ..... *E21B 37/00* (2013.01); *E21B 10/00* (2013.01); *E21B 21/002* (2013.01); *E21B 43/08* (2013.01); *E21B 43/121* (2013.01)

(58) Field of Classification Search

CPC ..... E21B 37/00; E21B 10/00; E21B 43/08; E21B 43/121; E21B 21/002

See application file for complete search history.

(56) References Cited

U.S. PATENT DOCUMENTS

| | | | | |
|---|---|---|---|---|
| 4,328 | A * | 12/1845 | Benson | E03B 5/06 417/104 |
| 6,695,058 | B1 * | 2/2004 | French | E21B 21/002 166/173 |
| 2004/0206508 | A1 * | 10/2004 | Chan | E21B 33/068 166/312 |
| 2015/0226036 | A1 * | 8/2015 | Wolf | E21B 23/00 166/311 |
| 2016/0348472 | A1 * | 12/2016 | Gosselin | E21B 17/076 |
| 2017/0030147 | A1 * | 2/2017 | Nkwocha | E21B 10/26 |
| 2018/0163729 | A1 * | 6/2018 | Xiao | F04D 13/086 |
| 2019/0360307 | A1 * | 11/2019 | Pipkin | E21B 37/00 |
| 2020/0300049 | A1 * | 9/2020 | Edvardsen | E21B 27/00 |

* cited by examiner

*Primary Examiner* — Tara Schimpf
*Assistant Examiner* — Neel Girish Patel
(74) *Attorney, Agent, or Firm* — McAfee & Taft

(57) ABSTRACT

A tool for cleaning debris from a wellbore comprises a rotational portion and a stationary portion. The rotational portion is configured to be coupled to a workstring disposed in the wellbore such that rotation of the workstring rotates the rotational portion. The stationary portion at least partially surrounds the rotational portion. The stationary portion is configured to remain stationary when the rotational portion and the workstring are rotated. The rotational portion and the stationary portion are shaped and configured such that, when the workstring is at least partially disposed in well fluid present in the wellbore, rotation of the rotational portion causes movement of well fluid such that well fluid flows into the workstring, thereby carrying debris from the wellbore into the workstring.

14 Claims, 7 Drawing Sheets

APPARATUS AND METHOD FOR REMOVING DEBRIS FROM A WELLBORE

CROSS-REFERENCE TO RELATED APPLICATIONS

This application claims priority to U.S. Provisional Patent Application No. 62/740,031, filed Oct. 2, 2018, the entirety of which is hereby incorporated herein by reference in its entirety.

FIELD OF THE DISCLOSURE

The present disclosure relates generally to downhole equipment for hydrocarbon wells. More particularly, the present disclosure pertains to a method and apparatus for removing debris from a wellbore.

BACKGROUND

Hydrocarbon fluids such as oil and natural gas are produced from a subterranean geologic formation, referred to as a reservoir, by drilling a wellbore that penetrates the hydrocarbon-bearing formation. After drilling, a casing can be lowered into the wellbore and various downhole operations can be performed and equipment placed to ready the well for production of oil or gas. In many wells, cleanout operations must be performed to remove sand and debris, which may accumulate as a result of well completion or production, to enable optimal production.

Known techniques for removing debris employ fluid circulation through either a venturi-style fluid suction device or actual circulation of either fluid or gas from the surface, or a combination of both techniques. However, these techniques and fluids are expensive and can add operational and safety risk. Debris removal systems that do not rely on fluid circulation also are known. Referred to as "sand pumps," these systems are mechanically operated in vertical or near-vertical wells to clean out debris through reciprocation of the work string or tubing. In such systems, rotation can be combined with reciprocation to help break up hard debris, but only reciprocation of the work string moves the fluid in the wellbore. More specifically, reciprocation of the work string (which carries the debris cleanout tools) moves the static fluid in the wellbore, creating a swabbing action that draws debris into a cavity or container where it is captured. The workstring can then be lifted from the wellbore so that the debris cavity can be retrieved and emptied. Although such systems are effective in a vertical section of the well, once the cleanout tool reaches a horizontal section, it begins to experience friction and non-optimal depth placement. Accordingly, such sand pumps are ineffective to remove debris from non-vertical wells.

SUMMARY

In one aspect, a tool for cleaning debris from a wellbore comprises a rotational portion and a stationary portion. The rotational portion is configured to be coupled to a workstring disposed in the wellbore such that rotation of the workstring rotates the rotational portion. The stationary portion at least partially surrounds the rotational portion. The stationary portion is configured to remain stationary when the rotational portion and the workstring are rotated. The rotational portion and the stationary portion are shaped and configured such that, when the workstring is at least partially disposed in well fluid present in the wellbore, rotation of the rotational portion causes movement of well fluid such that well fluid flows into the workstring, thereby carrying debris from the wellbore into the workstring.

In another aspect, a system for cleaning debris from a wellbore includes an upper workstring portion, a lower workstring portion, and a fluid moving tool coupled between the upper and lower workstring portions. The fluid moving tool includes a rotational portion and a stationary portion. Rotation of the upper workstring portion causes rotation of the rotational portion. The rotational portion and the stationary portion are shaped and configured such that, when the lower workstring portion is at least partially disposed in well fluid, rotation of the rotational portion causes movement of the well fluid such that well fluid flows into the lower workstring portion, thereby carrying debris from the wellbore into the lower workstring portion.

In another aspect, a method of removing debris from a wellbore includes connecting a fluid moving tool to a workstring, the fluid moving tool including a rotational portion that rotates when the workstring is rotated. The method further includes running the workstring into a wellbore in which fluid is present. The method further includes moving the fluid into a lower end of the workstring by rotating the workstring to rotate the rotational portion of the fluid moving tool.

BRIEF DESCRIPTION OF THE DRAWINGS

Certain embodiments of the invention are described with reference to the accompanying drawings, wherein like reference numerals denote like elements. It should be understood, however, that the accompanying drawings illustrate only the various implementations described herein and are not meant to limit the scope of various technologies described herein. Various embodiments of the current invention are shown and described in the accompanying drawings of which.

Figure 1:
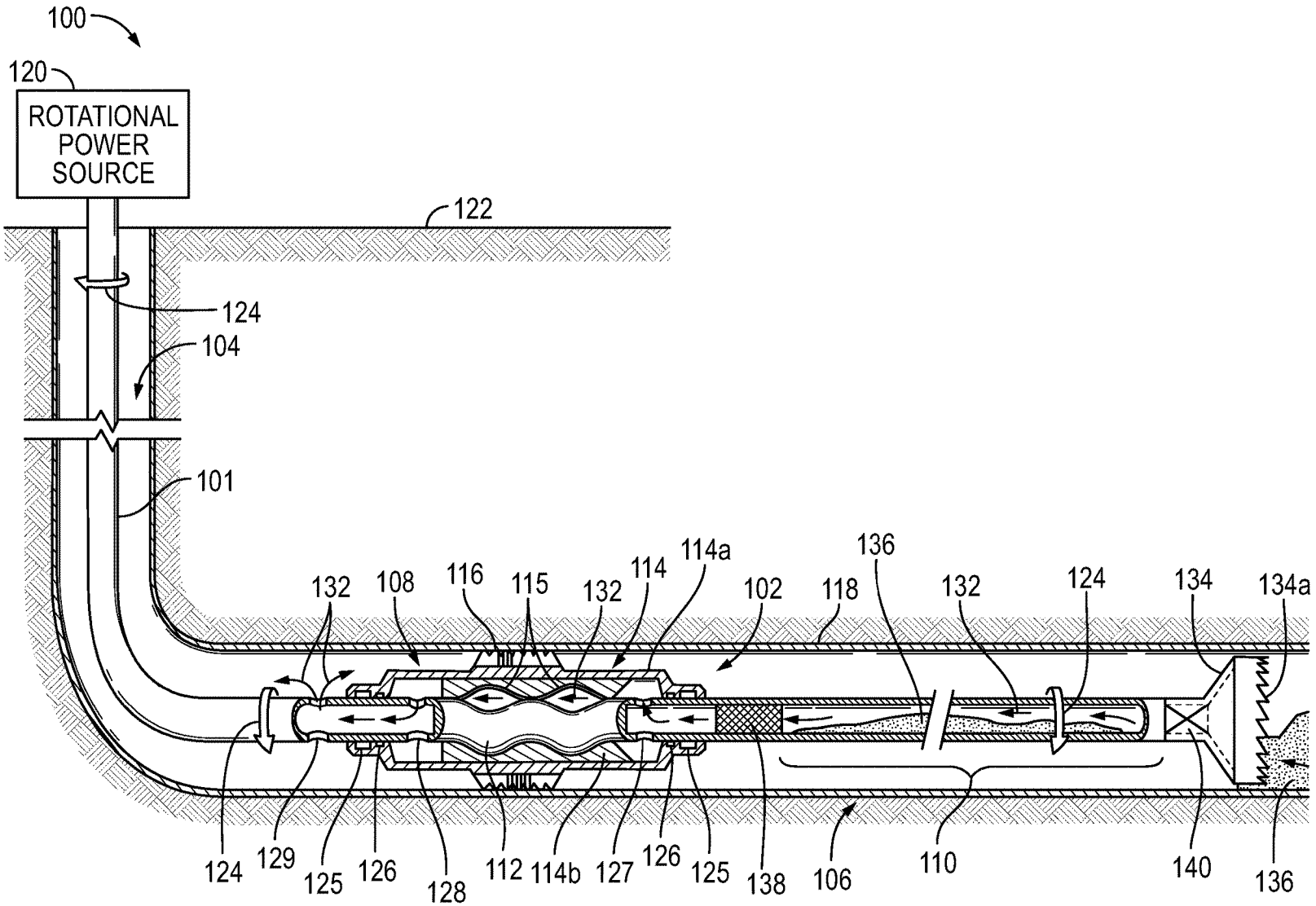
FIG. 1 illustrates a workstring system deployed in a wellbore, the system including a cleanout assembly for removing debris from the wellbore, according to an embodiment.

The headings provided herein are for convenience only and do not necessarily affect the scope or meaning of what is claimed in the present disclosure.

DETAILED DESCRIPTION

Various examples and embodiments of the present disclosure will now be described. The following description provides specific details for a thorough understanding and enabling description of these examples. One of ordinary skill in the relevant art will understand, however, that one or more embodiments described herein may be practiced without many of these details. Likewise, one skilled in the relevant art will also understand that one or more embodiments of the present disclosure can include other features and/or functions not described in detail herein. Additionally, some well-known structures or functions may not be shown or described in detail below, so as to avoid unnecessarily obscuring the relevant description.

Certain terms are used throughout the following description to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion, any reference to up or down in the description is made for purposes of clarity, with "up", "upper", "upwardly", or "upstream" meaning toward the surface of the borehole and with "down", "lower", "downwardly", "downhole", or "downstream" meaning toward the terminal end of the borehole, regardless of the borehole orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The term "debris" as used herein refers to any solid or accumulation of material that hinders optimum production of a well, such as sand, scale, metal shavings, junk, etc.

The systems and techniques that are described herein for removing debris from a wellbore convert rotational torque applied to a workstring into a downhole fluid pumping action that can be used to remove debris from the wellbore. The pumping action draws fluid that is present in the wellbore into the end of the workstring, carrying debris along with the fluid flow. The workstring is coupled to a fluid moving tool that operates through rotation of the workstring to pull fluid and debris from the wellbore into an inner volume (or cavity) within the workstring where the debris can be retained. The workstring (or tubing) may be rotated by a power source that, in some embodiments, can be located at the surface of the wellbore. The rotational power source can be, for example, a power swivel, top drive drilling rig or a rotary (i.e., a rig used to power rotary drilling of a wellbore). The fluid moving tool can be, for example, a progressive cavity pump that uses mechanical rotation as power to create movement of static wellbore fluid. By using surface rotation of the workstring to move static fluid in the wellbore and capture debris, the need to pump circulating fluids into the wellbore to perform cleanout operations may be eliminated. This can significantly increase the efficiency of wellbore cleanout and reduce the costs associated therewith.

In operation, the workstring that the fluid moving tool is coupled to is lowered into a wellbore where well fluid is present in the wellbore. The fluid moving tool includes a rotational portion that rotates within a stationary portion. Rotation of the rotor within the stationary portion forces well fluid to move through the fluid moving tool, which carries debris from the wellbore into the workstring.

In various embodiments, the stationary portion can include a stationary elastomeric sleeve that is sized to create a series of cavities with the rotational portion to form a progressive cavity pump. In embodiments, the stationary portion can be held in place and prevented from rotating by anchors, such as drag blocks, gripping arms, abrasive material or the like, that contact the casing of the wellbore and prevent the stationary portion from rotating inside of the wellbore casing when the workstring is rotated.

In various embodiments, the length and volume of the lower portion of the workstring forms a cavity to hold the debris with one or more filters or screens filtering the debris from the well fluid. The systems may include check valves or other flow restriction devices at the bottom of the workstring to prevent the debris from falling out of the cavity when the workstring is pulled from the wellbore for debris retrieval. In other embodiments, the debris can be removed by pumping the debris through the workstring up to the surface. Filters or screens can be employed to restrict the size of debris particles or pieces that can enter the fluid moving tool to thereby reduce friction and extend the service life of the fluid moving tool.

The system can include other tools or devices that are positioned below the fluid moving tool and, in some embodiments, near the bottom of the workstring to assist in filtering, capturing and storing debris for retrieval at the surface. The distance between such tools or devices and the fluid moving tool can be relatively short (e.g., 30 feet as an example) or very long (e.g., thousands of feet). These tools or devices can include back check ball valves, finger baskets, flapper valves, darts, etc. that prevent the debris from falling out of the workstring when the workstring is pulled from the wellbore after cleanout operations have been completed.

In operation, as the workstring is rotated, it may also be translated within the wellbore (e.g., lowered) to engage debris. The fluid motion created by the fluid moving tool draws debris into the end of the workstring for collection and capture in the debris cavity. In embodiments, the debris cavity can be a section of the workstring that provides a volume for collecting the debris.

In various embodiments, the section of the workstring that is further in the wellbore than the fluid moving tool is coupled to the fluid moving tool such that it rotates in conjunction with the upper section of the workstring using the same rotational power source. In such embodiments, the torque and resulting rotation above and below the fluid moving tool is transmitted directly through or otherwise coupled with the fluid moving tool's rotational portion. Rotation of the full length of the workstring may enable tools or devices at the lower end of the workstring to drill into or otherwise break up debris. Such tools or devices can include a drill bit, mill, notch collar, rotary shoe, or other similar devices or combinations of devices that include sharpened teeth or edges that are configured to break and move debris. Rotation of the workstring may also provide the benefit of breaking sliding friction forces between the workstring and the casing, thus assisting with deeper penetration into horizontal sections of the wellbore. In various embodiments, clutches and other mechanical or hydraulic systems can be incorporated in the system to transmit rotation to the end of the workstring to help break up debris or to reduce friction between the workstring and the casing. Rotation of the workstring may also allow for more reliable retrieval of the workstring from the wellbore.

Fluids present in the wellbore during the cleanout operation can be expelled or returned from the workstring into the wellbore at or above the fluid moving tool. In other embodiments, the fluid instead can be pumped to the surface while carrying the suspended debris in a slurry-like mixture.

The rate of rotation of the workstring and the rotational portion of the fluid moving tool may be variable. The velocity of the fluid in the system can vary and generally will depend on the configuration of the fluid moving tool and the speed of the rotation of the workstring and the rotational portion of the fluid moving tool. In various embodiments, during use, the workstring and the rotational portion of the fluid moving tool are rotated at a rate of about 60 to 150 revolutions per minute.

Turning now to FIG. 1, a system 100 including a workstring 101 and a cleanout assembly 102 is shown. FIG. 1 shows the system 100 lowered into a wellbore 104. In some implementations, the wellbore 104 has a non-vertical section 106 and the cleanout assembly 102 is positioned at least partially in the non-vertical section 106. The workstring 101 can be made up of a plurality of tubulars or other members coupled together as needed to extend into the wellbore 104 and position the cleanout assembly 102 at the desired depth. The wellbore 104 may be lined by a casing 118 to support the wellbore. The casing 118 may be made up of a series of sections of pipe coupled together.

The cleanout assembly 102 includes a fluid moving tool 108 and a portion of workstring 101 defining a debris chamber or cavity 110. The fluid moving tool 108 includes a rotational portion 112 coupled to the workstring 101 such that the rotational portion 112 rotates with the workstring as described in more detail herein and as illustrated by arrows 124 in FIG. 1. Although string 101 is referred to herein as a "workstring," it should be understood that string 101 can be a drill pipe string, tubing, production string or any other string that can provide rotation to the fluid moving tool 108.

In various embodiments, the fluid moving tool 108 also includes a stationary portion 114. The stationary portion 114 is configured as a tube inside of which the rotational portion 112 is at least partially disposed. In various embodiments, the rotational portion 112 and the stationary portion 114 together form a progressive cavity pump to create movement of well fluid in the wellbore. In such embodiments, as shown in FIG. 1, the rotational portion 112 and the stationary portion 114 each include a plurality of lobes that together form a plurality of sequential cavities 115 for pumping the fluid. Although a limited number of cavities 115 are shown in FIG. 1 for illustration purposes, the rotational portion 112 and the stationary portion 114 can define any number of cavities 115. For example, in one embodiment, the rotational portion 112 has seven lobes and the stationary portion 114 has eight lobes. In some embodiments, the stationary portion 114 includes a cylindrical body 114*a* and an insert 114*b* disposed within the bore of the cylindrical body 114*a*. The insert 114*b* may form the cavities 115 with the stationary portion 114. In some embodiments, the insert 114*b* is constructed from an elastomeric material.

The workstring 101 is coupled at its upper end (i.e., the end nearer the wellbore opening) to a rotational power source 120 that may be located at the surface 122 of the wellbore 104, such as a power swivel, top drive drilling rig, a rotary, or a fluid-driven motor, for example. In other embodiments, the workstring 101 can be rotated with a rotating power source that is located downhole. The direction of rotation of the workstring 101 and rotational portion 112 is denoted in FIG. 1 by arrows 124.

In some embodiments, anchors 116 are coupled to the cylindrical body 114*b* of the stationary portion 114. The anchors 116 are configured to contact the casing 118 of the wellbore 104 to prevent rotation of the stationary portion 114. The anchors 116 ensure that the stationary portion 114 remains stationary when the rotational portion 112 is rotated with the workstring 101.

The fluid moving tool 108 also includes bearings 125 to provide smooth rotation of the rotational portion 112 relative to the stationary portion 114. The fluid moving tool 108 may further include upper and lower seals 126 coupled to the stationary portion 114 and contacting the rotational portion 112 to seal about the rotational portion 112.

As the rotational portion 112 rotates within the stationary portion 114, fluid is pumped from the lower portion of the workstring 101 (i.e., the portion that is further from the wellbore opening) through the fluid moving tool 108, toward the surface of the wellbore. The fluid flows from the lower portion of the workstring 101 through one or more apertures 127 in the rotational portion to enter the space between the rotational portion 112 and the stationary portion 114. The rotational portion 112 can include any number of apertures 127 (e.g., one aperture, two apertures, three apertures, etc.). The rotation of the rotational portion 112, and pumping of fluid through the fluid moving tool 108, pulls fluid through the lower portion of the workstring 101 toward the fluid moving tool 108. As a result, fluid is pulled into the downstream opening of the workstring 101, carrying debris 136 from the wellbore along with it. The debris 136 is filtered by the debris filter 138 such that the debris 136 is retained in the debris chamber 110.

The rotational portion 112 may further include upper apertures 128 through which, after passing through the cavities 115, the fluid passes from the space between the rotational component 112 and the stationary component 114 into an inner bore of the rotational component 112. The rotational portion 112 may further include fluid exit ports 129 to allow fluid flow 132 to exit the rotational portion 112 and return to the wellbore 104 during the cleanout operation.

In the embodiment shown, the system 100 includes a tool 134 at the lower end of the workstring 101 to assist with breaking up debris 136 in the wellbore 104. The tool 134 can include one or more sharpened edges or sharpened teeth 134*a* configured to break up the debris 136. For example, the tool 134 may be a mill, a drill bit, workover bit, rotary shoe or other suitable tool that can break up debris 136. The system 100 may also include a mule shoe or other device at the end of the workstring 101 that allows the passage of fluid therethrough. When the workstring 101 is rotated, the tool 134 breaks up debris 136 and the fluid moving tool 102 creates the fluid flow 132 which carries the debris 136 into the end of workstring 101 where it may be collected in the lower workstring portion 110.

A debris filter 138 is positioned in the lower workstring portion below the fluid moving tool 108 to form a debris chamber 110 in the lower workstring portion. The debris filter 138 prevents debris particles that are larger than a specified size from entering the fluid moving tool 108. In such an embodiment, the debris 136 may be removed from the debris chamber 110 by pulling the workstring 101 from the wellbore 104 and emptying the debris chamber 110. In addition to capturing debris 136 in the debris chamber 110, the debris filter 138 also restricts the entry of debris particles into the fluid moving tool 108. This may reduce wear of the fluid moving tool 108 and increase its service life.

In other embodiments, the system 100 does not include a debris filter and the debris is pumped to the surface for removal. This may be appropriate for implementations in which the debris in the wellbore is generally of a smaller size. Such embodiments are described further below.

In the embodiment shown in FIG. 1, the workstring 101 also includes a downhole device 140, such as a check valve, flapper valve and/or finger baskets, to prevent fluid and debris from exiting the debris chamber 110 through the end of the lower end of the workstring 101.

Figure 2:
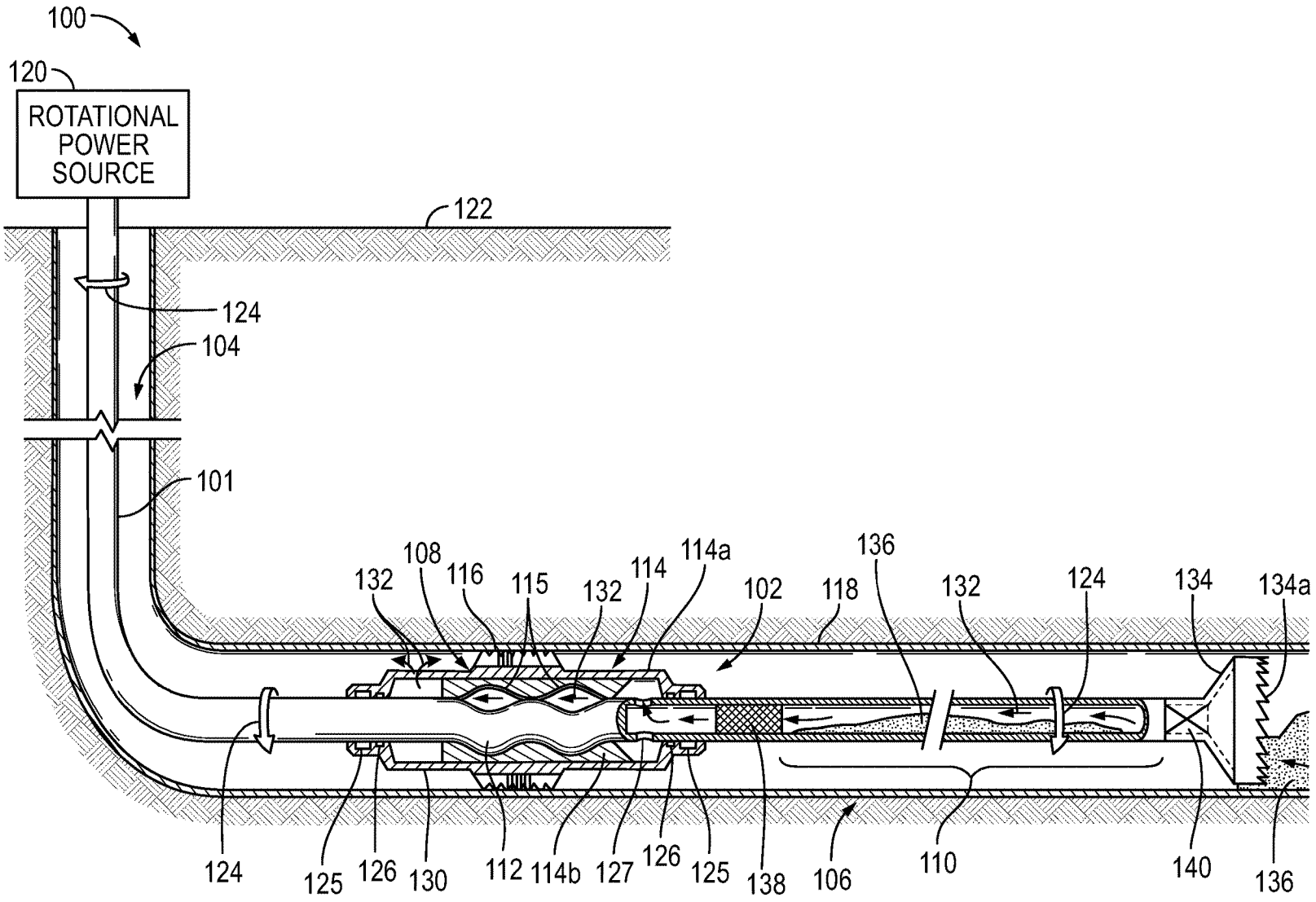
FIG. 2 illustrates a workstring system deployed in a wellbore, the system including a cleanout assembly for removing debris from the wellbore, according to another embodiment.

FIG. 2 illustrates another embodiment of a debris cleanout assembly 102 that in many aspects may be similar to the embodiment shown in FIG. 1. In the embodiment of FIG. 2, the rotational portion 112 does not include upper apertures 128 and exit ports 129. Instead, in this embodiment, the stationary portion 114 includes apertures 130 through which fluid can flow from the space between the rotational component 112 and the stationary portion 114 and back into the wellbore, as illustrated by the arrows 132. It should be understood that, although not illustrated, in other embodiments, the rotational portion 112 includes upper apertures 128 and exit ports 129 and the stationary portion includes exit ports 130.

Figure 3:
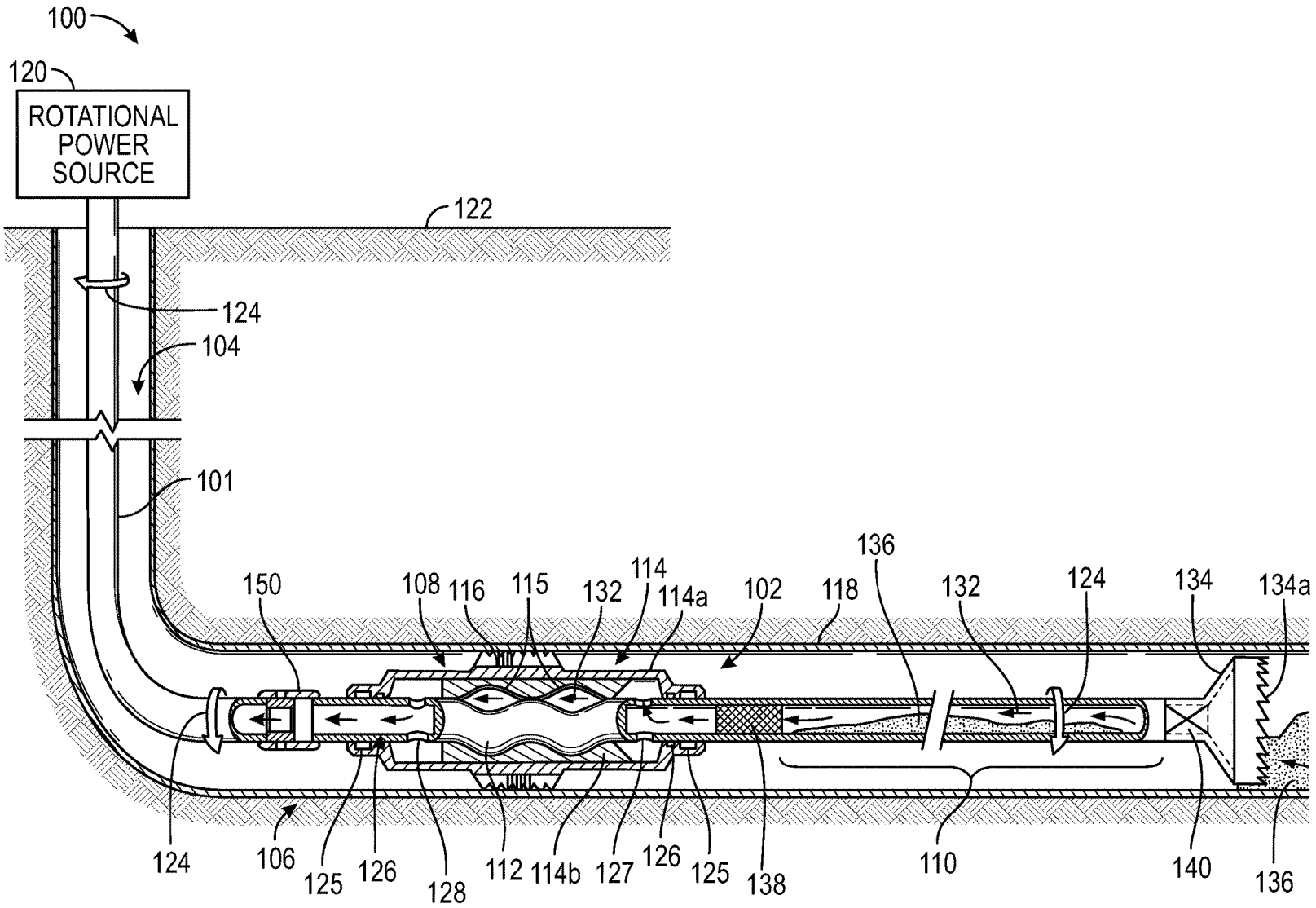
FIG. 3 illustrates a workstring system deployed in a wellbore, the system including a cleanout assembly for removing debris from the wellbore, according to another embodiment.

FIG. 3 illustrates another embodiment of a debris cleanout assembly 102 in which the fluid flow 132 is pumped to the surface 122 while carrying suspended debris 136 in a slurry-like mixture. This embodiment does not include a fluid exit port, as in the embodiments of FIGS. 1 and 2. As a result, the fluid does not return to the wellbore 104 after passing through the fluid moving tool 108. Instead, after passing through apertures 128 in the rotational portion 112, the fluid is pumped to the surface 122. The fluid can then be filtered at the surface to remove debris present therein. After filtering, the fluid can be returned to the wellbore. In this embodiment, the workstring 101 may include a drop ball-actuated circulation sub 150 positioned above the fluid moving tool 108. The sub 150 allows the workstring to be blocked prior to removal of the workstring 101 from the wellbore 104. Once the cleanout operation is complete, a ball can be dropped to actuate the sub 150, thus allowing fluid to drain from the workstring 101 as it is being pulled from the wellbore 104.

Figure 4:
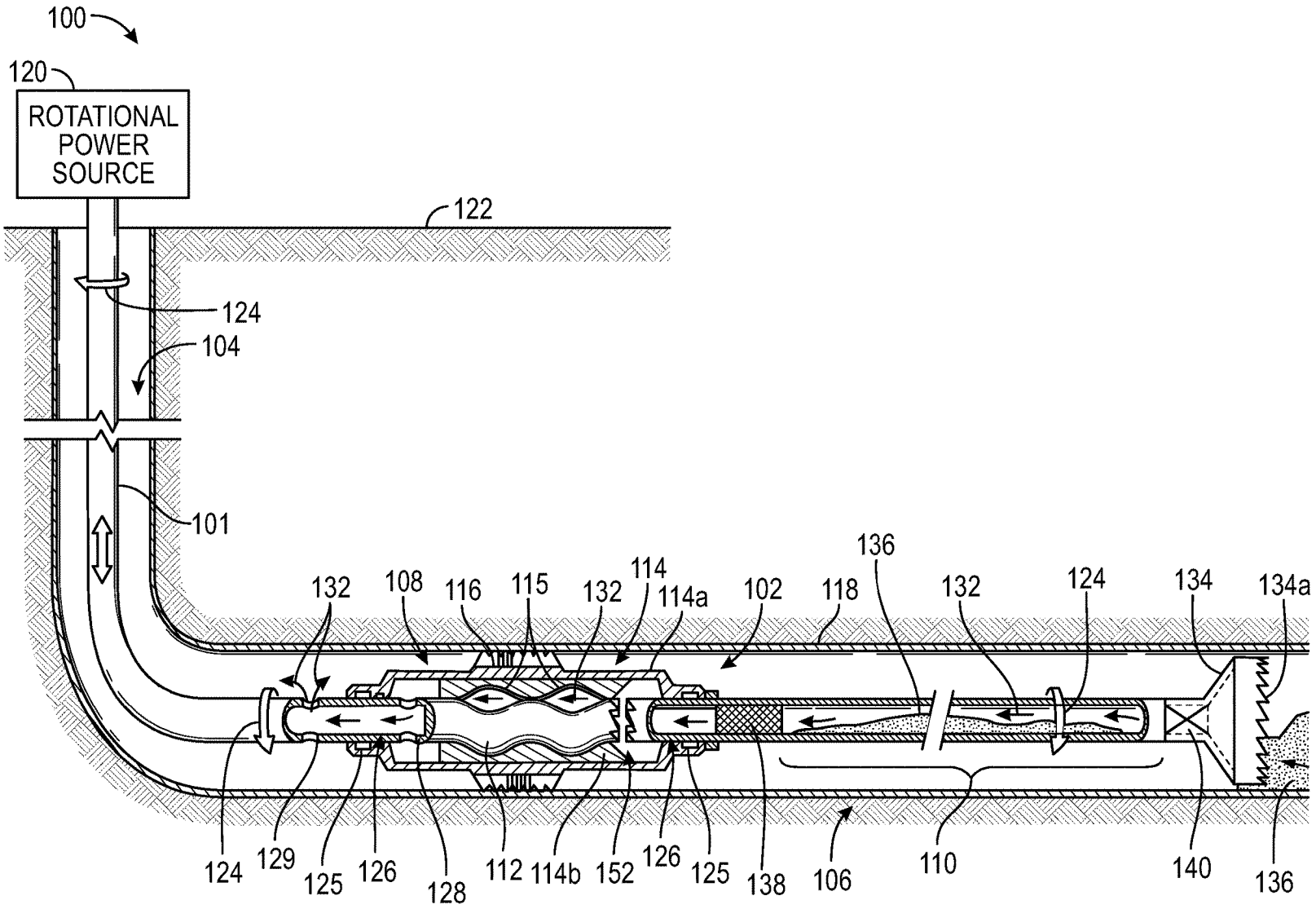
FIG. 4 illustrates a workstring system deployed in a wellbore, the system including a cleanout assembly for removing debris from the wellbore, according to another embodiment.

FIG. 4 illustrates an embodiment of a debris cleanout assembly 102 that includes a clutch mechanism 152 that allows the upper section of the workstring 101 to rotate independently of the lower section of the workstring 101. In this embodiment, the clutch mechanism 152 may be normally disengaged such that the lower portion of the workstring 101 does not rotate with the upper portion of the workstring 101 and the rotational portion 112. When the upper portion of the workstring 101 and the rotational portion 112 is moved downward, the clutch mechanism 152 engages so that the lower section of the workstring 101 rotates with the upper section of the workstring 101 and the rotational portion 112. As with the embodiment illustrated in FIG. 1, the fluid flow 132 is expelled from the workstring 101 via exit ports 129 and returned to the wellbore 104.

Figure 5:
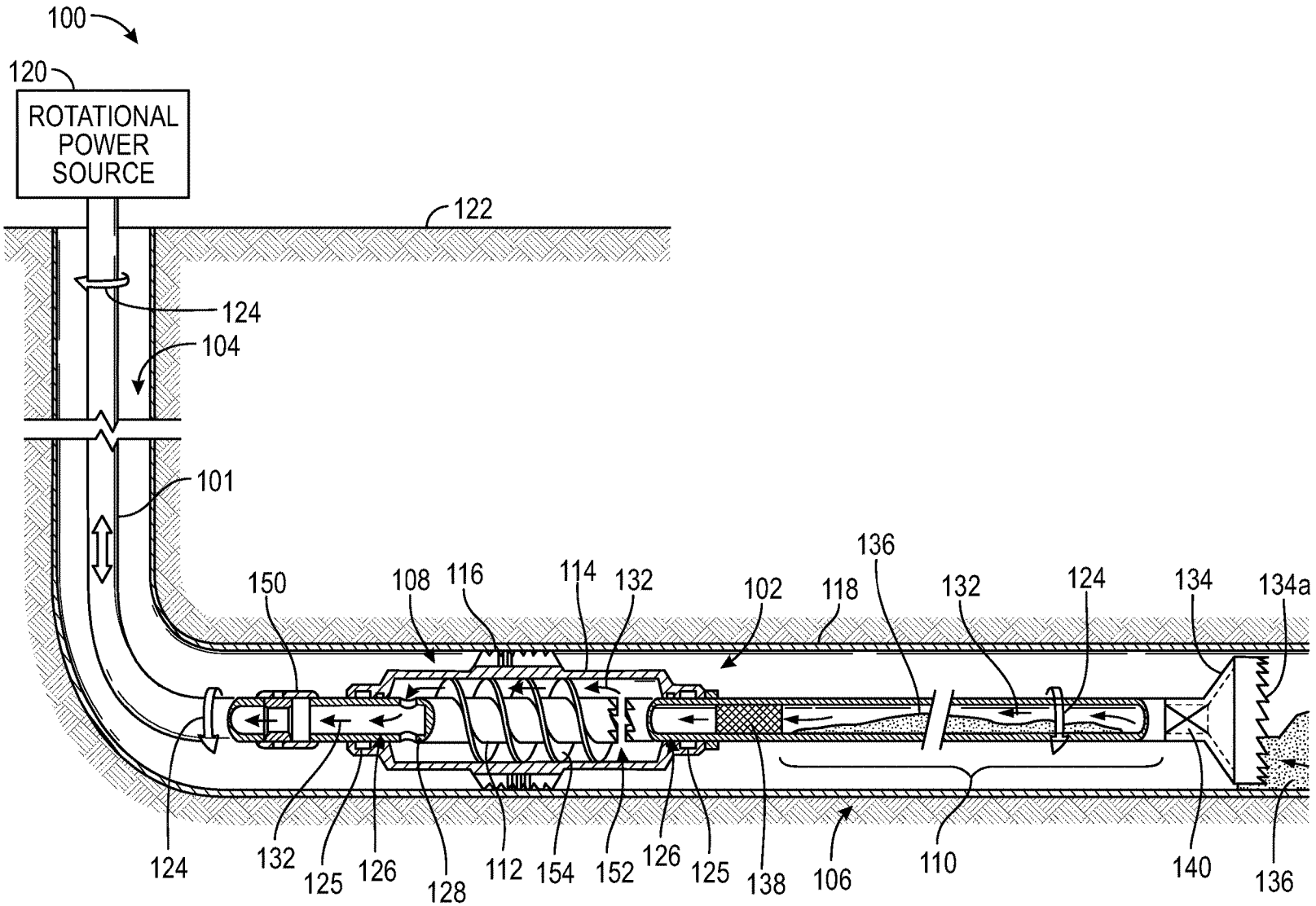
FIG. 5 illustrates a workstring system deployed in a wellbore, the system including a cleanout assembly for removing debris from the wellbore, according to another embodiment.

FIG. 5 illustrates a further embodiment of a debris cleanout assembly 102 that includes a clutch mechanism 152. Again, in this embodiment, the clutch mechanism 152 may be normally disengaged such that the lower portion of the workstring 101 does not rotate with the upper portion of the workstring 101 and the rotational portion 112. When the upper portion of the workstring 101 and the rotor is moved downward, the clutch mechanism 152 engages so that the lower section of the workstring 101 rotates with the upper section of the workstring 101 and the rotational portion 112. As with the embodiment illustrated in FIG. 3, fluid 132 carrying the debris 136 is pumped to the surface 122.

In the embodiment of FIG. 5, a portion of the rotational component 112 is in the form of an auger 154. In such embodiments, the auger 154 has a helical face that forces fluid through the fluid moving tool 108 when the auger 154 is rotated. It should be understood that an auger-type rotor as shown in FIG. 5 and the progressive cavity pump-type rotor and stator shown in FIGS. 1-4 can be combined or substituted for one another in any of the embodiments described herein.

In any of the embodiments described herein, during operation of the fluid moving tool, a reverse circulation of fluid (i.e., fluid introduced into the wellbore from the surface) may be introduced into the annulus between the casing 118 and the workstring 101 to work in conjunction with the fluid moving tool to further enhance the flow of well fluid in the wellbore and removal of debris from the wellbore.

FIGS. 6-9 illustrate one embodiment of a fluid moving tool 200 in detail. The fluid moving tool 200 includes a rotational portion 202 and a stationary portion 204. The rotational portion 202 is configured to be coupled to, and rotate with, a workstring (e.g., workstring 101) and the stationary portion 204 is configured to remain stationary within the wellbore (e.g., wellbore 104), as described above. The rotational portion 202 includes a rotor 206 and the stationary portion includes a stator 208. As described above, the rotation of the rotational portion 202 within the stationary portion 204 causes flow of the well fluid into the workstring (e.g., workstring 101) for removal of debris. The rotor 206 and stator 208 can form a progressive cavity pump, as illustrated in FIGS. 1-4. As also described above, the stator 208 can include a cylindrical body and an insert. In such embodiments, the insert and the rotor 206 can form a progressive cavity pump having a series of cavities to pump fluid through the fluid moving tool 200. Alternatively, the rotor 206 can be in the form of an auger, as illustrated in FIG. 5.

In addition to the rotor 206, the rotational portion 202 further includes a first shaft 210-1 coupled to a first end of the rotor 206 and a second shaft 210-2 coupled to a second, opposite end of the rotor 206. The shafts 210-1, 210-2 are configured to rotate with the rotor 206 during operation and can be coupled to the rotor 206 in any appropriate way (e.g., threaded connection, press-fit, welded connection, etc.). In some embodiments, one or both of the shafts 210-1, 210-2 may be joined to the rotor 206 using a keyed or faceted joint to prevent relative rotation between the rotor 206 and the shafts 210-1, 210-2.

The rotational portion 202 further includes a first coupler 212-1 and a second coupler 212-2 engaged with the first shaft 210-1 and the second shaft 210-2, respectively. The couplers 212-1, 212-2 are configured to join the rotational portion 202 to the workstring (e.g., workstring 101). The couplers 212-1, 212-2 are configured to rotate with the rotor 206 and the shafts 210-1, 210-2 during operation and can be coupled to the shafts 210-1, 210-2 in any appropriate way (e.g., threaded connection, press-fit, welded connection, etc.). In some embodiments, one or both of the coupler 212-1, 212-2 may be joined to the respective shaft 210-1, 210-2 using a keyed or faceted joint to prevent relative rotation between the rotor 206 and the shafts 210-1, 210-2.

In some embodiments, the shafts 210-1, 210-2 may be configured to flex during operation to allow for misalignment of the rotor 206 and the couplers 212-1, 212-2 (or the workstring). In some embodiments, the shafts 210-1, 210-2 include reduced diameter portions to provide this flexibility. Additionally, or alternatively, the shafts 210-1, 210-2 can be constructed of a material that has a stiffness that is sufficiently low to allow flexing of the shafts 210-1, 210-2.

In addition to the stator 208, the stationary portion 204 includes a first housing 216-1 coupled to a first end of the stator 208 and a second housing 216-2 coupled to a second end of the stator 208. Each housing 216-1, 216-2 may include one or more bodies coupled together to form the housing 216. The first housing 216-1 at least partially surrounds the first shaft 210-1 and the first coupler 212-1. The second housing 216-2 at least partially surrounds the second shaft 210-1 and the second coupler 212-1. A first annular space 218-1 is defined between the first housing 216-1 and the first shaft 210-1. A second annular space 218-2 is formed between the second housing 216-2 and the second shaft 210-2.

Figure 9:
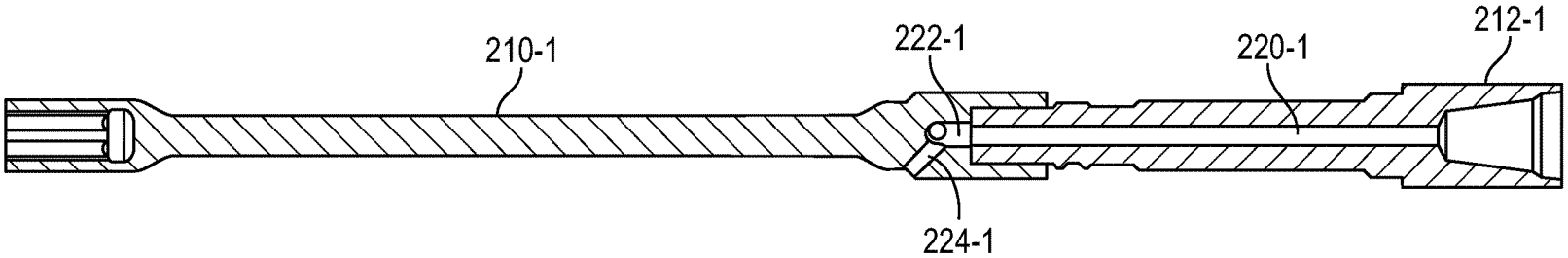
FIG. 9 is a detail cross-sectional view of a shaft and coupler of the fluid moving tool of FIG. 6.

FIG. 9 shows a cross-sectional view of the shaft 210-1 and the coupler 212-1. As shown in this figure (as well as the detail view of the fluid moving tool 200 shown in FIG. 7), the coupler 212-1 defines a bore 220-1 that communicates with the inner bore of the workstring (e.g., workstring 101) to allow fluid to flow from the workstring and into the fluid moving tool 200. The shaft 210-1 defines a cavity 222-1 in fluid communication with the bore 220-1 of the coupler 212-1. The shaft 210-1 further defines an aperture 224-1 extending from the cavity 222-1 into the annular space 218-1 between the shaft 210-1 and the stationary portion 204 such that the fluid can flow into the space between the rotor 206 and the stator 208.

Figure 8:
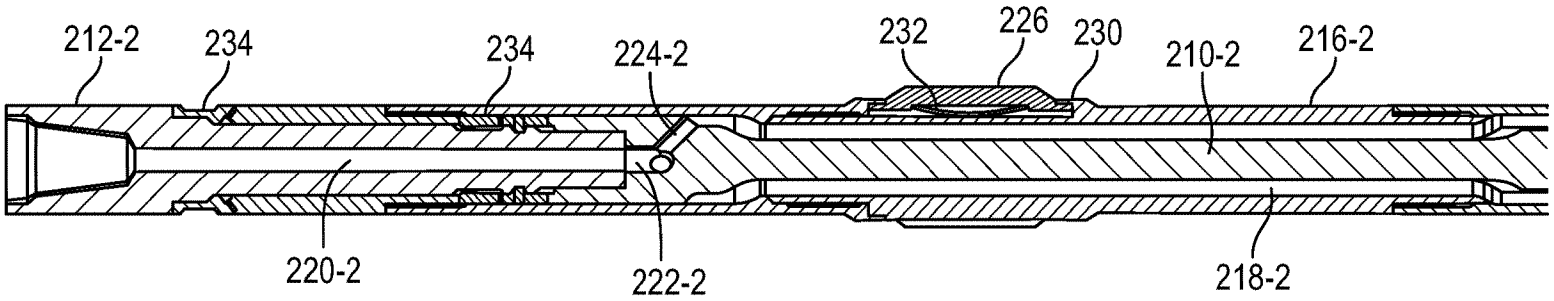
FIG. 8 is a detail cross-sectional view of a second end of the fluid moving tool of FIG. 6.

As shown in FIG. 8, at the opposite end of the rotor 206, the shaft 210-2 defines an aperture 224-2 through which the fluid flows from the annular space 218-2 between the shaft 210-2 and the stationary portion 204 to the bore 220-2 of the coupler 212-2. The fluid that enters the bore 220-2 can be pumped to the surface, as described above with respect to FIGS. 2 and 4, or can exit through fluid exit ports, as described in FIGS. 1 and 3. In various embodiments, the fluid exit ports can extend through the coupler 212-2. In other embodiments, a tubular of the workstring that is coupled to the coupler 212-2 can include fluid exit ports.

Figure 6:
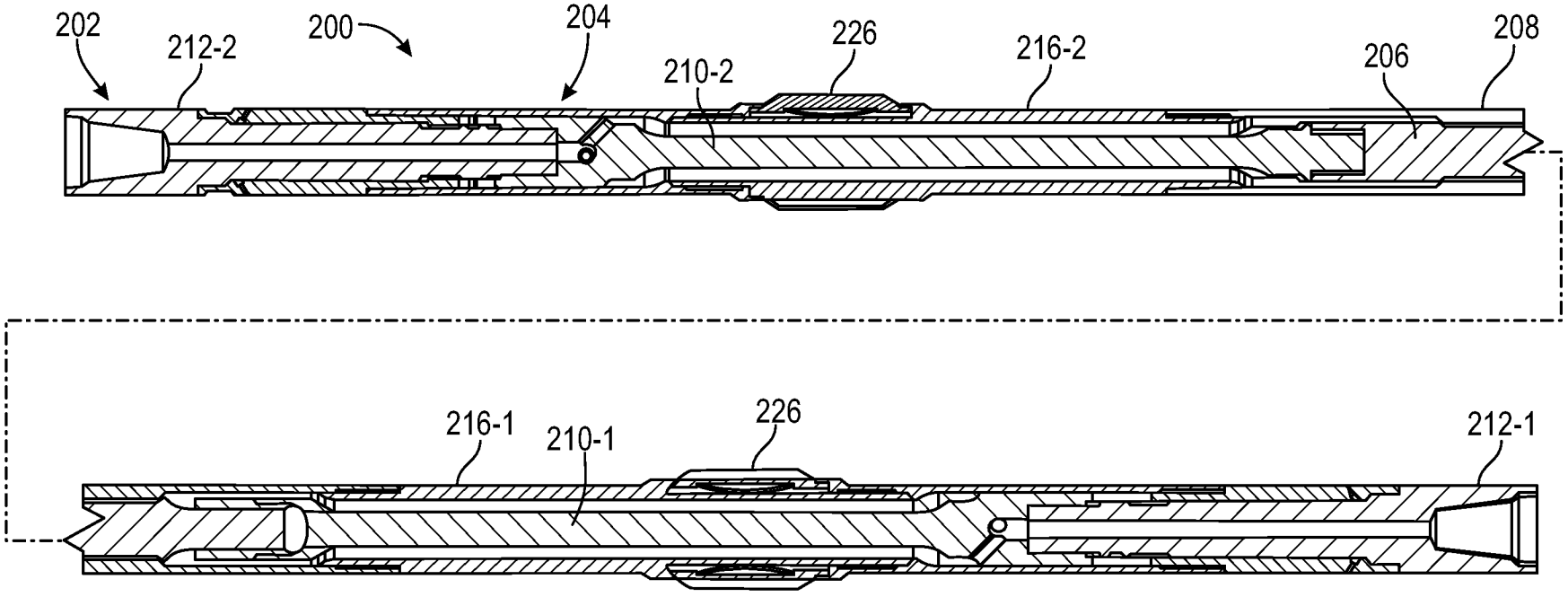
FIG. 6 illustrates a cross-sectional view of a fluid moving tool, according to an embodiment.
Figure 7:
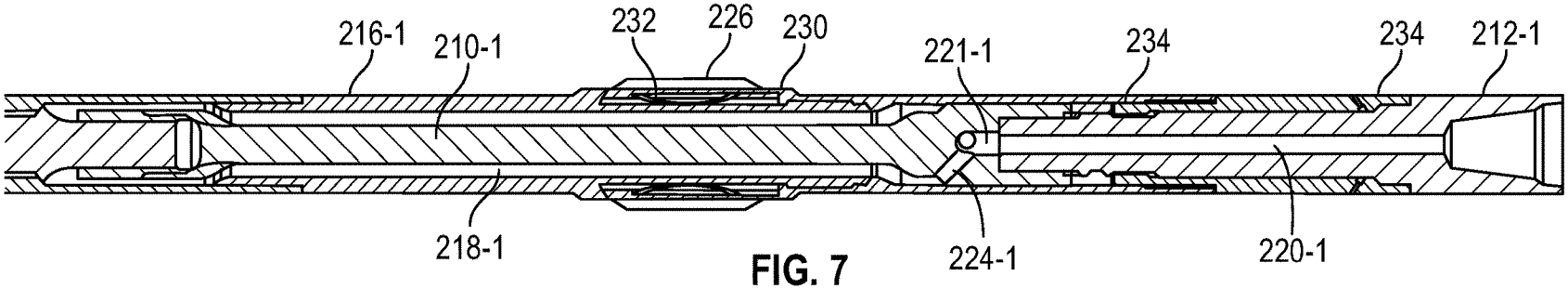
FIG. 7 is a detail cross-sectional view of a first end of the fluid moving tool of FIG. 6.

As shown in FIGS. 6-8, the stationary portion 204 further includes anchors 226 extending outward from one or both of the housings 216-1, 216-2. As described above, the anchors 226 are configured to engage the casing (e.g., casing 118) of the wellbore (e.g., wellbore 104) to prevent rotation of the stationary portion 204. In some embodiments, the housings 216-1, 216-2 each define cavities within which the anchors 226 are partially disposed. In the illustrated embodiment, the housing includes lips 230 to retain the anchors 226. In some embodiments, the stationary portion 204 includes biasing members 232 within the cavities that bias the anchors 226 outward such that the anchors 226 maintain contact with the casing (e.g., casing 118) of the wellbore (e.g., wellbore 104). The biasing members 232 can be, for example, leaf springs, helical compression springs, an elastomeric member, or any other member configured to apply a force to bias the anchors 226 outward.

As shown in FIG. 6, the fluid moving tool 200 may further include a plurality of bearings 234 to facilitate rotation of the rotational portion 202 with respect to the stationary portion 204.

In another aspect, a method of removing debris from a wellbore includes connecting a fluid moving tool to a workstring. The fluid moving tool may be, for example, according to any of the embodiments described herein and include a rotational portion that rotates when the workstring is rotated. The method further includes running the workstring into a wellbore in which fluid is present. The method further includes moving the fluid into a lower end of the workstring by rotating the workstring to rotate the rotational portion of the fluid moving tool. In various embodiments, the method further comprises capturing wellbore debris carried in the moving fluid in a debris chamber in the workstring. The method may further include recirculating the moving fluid by expelling the moving fluid from the workstring through a fluid exit port located at or above the fluid moving tool. In some embodiments, the method further comprises pumping the fluid to the surface of the wellbore with the debris suspended in the fluid in a slurry-like mixture. In some embodiments, the method further includes providing a debris breakup device proximate a lower end of the workstring such that rotation of the workstring rotates the debris breakup device to break up accumulated debris in the wellbore.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. Descriptions of features or aspects within each embodiment should typically be considered as available for other similar features or aspects in other embodiments unless stated otherwise. The terminology used herein is for the purpose of describing the particular embodiments and is not intended to be limiting of exemplary embodiments of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the scope of the invention as defined by the following claims. Therefore, the scope of the invention is not confined by the detailed description of the invention but is defined by the following claims.

What is claimed is:

1. A tool for cleaning debris from a wellbore, the tool comprising:

a rotational portion configured to be coupled to a first tubular housing that defines an upper exterior portion of a workstring assembly disposed in the wellbore such that rotation of the first tubular housing rotates the rotational portion, and wherein the rotational portion comprises:

a rotor;

a shaft configured to couple to the rotor and rotate with the rotor; and a coupler configured to be coupled at a first end to the first tubular housing of the workstring assembly and at a second end to the shaft such that the coupler rotates with the first tubular housing, the shaft, and the rotor, wherein the coupler defines a bore through which well fluid can flow;

wherein the shaft defines at least one aperture through which fluid can flow from the bore of the coupler to a space between the rotor and the stationary portion; and a stationary portion at least partially surrounding the rotational portion, wherein the stationary portion is configured to remain stationary relative to the first tubular housing while rotation of the first tubular housing rotates the rotational portion;

wherein the rotational portion and the stationary portion are shaped and configured such that, when the workstring assembly is at least partially disposed in well fluid present in the wellbore, rotation of the first tubular housing relative to the stationary portion rotates the rotational portion relative portion relative to the stationary portion and thereby causes movement of well fluid such that well fluid flows into the workstring assembly, thereby carrying debris from the wellbore into the workstring assembly.

2. The tool of claim 1, wherein the rotor is in the form of an auger.

3. The tool of claim 1, wherein the stationary portion includes anchors that are configured to engage a casing of the wellbore to restrict rotation of the stationary portion while the first tubular housing of the workstring assembly and the rotational portion are rotating.

4. The tool of claim 1, wherein the rotor and the stationary portion form a progressive cavity pump.

5. The tool of claim 1, wherein the shaft is configured to flex to accommodate misalignment of the rotor and the coupler.

6. The tool of claim 1, wherein the rotational portion defines one or more exit ports such that when the first tubular housing of the workstring assembly and the rotational portion are rotated fluid is expelled from the rotational portion and returns to the wellbore through the one or more fluid exit ports.

7. The tool of claim 1, wherein the stationary portion comprises:

a stator at least partially surrounding the rotor; and a housing coupled to the stator, wherein the housing at least partially surrounds the shaft and the coupler.

8. The tool of claim 7, wherein the stationary portion further comprises at least one anchor configured to engage a casing of the wellbore to restrict rotation of the stationary portion while the first tubular housing and the rotatable potion are rotating.

9. A system for cleaning debris from a wellbore, the system comprising:

a workstring assembly comprising:

an upper tubular portion defining an upper exterior housing of the workstring assembly;

a lower tubular portion defining a lower exterior housing of the workstring assemlby;

a fluid moving tool coupled between the upper and lower tubular portions, the fluid moving tool including a rotational portion and a stationary portion at least partially surrounding the rotational portion, wherein rotation of the upper tubular portion relative to the stationary portion rotates the rotational portion relative to the stationary portion: and a rotational power source located at a surface of the wellbore, wherein the upper tubular portion is coupled to the rotational power source such that the rotational power source can provide rotational energy to rotate the upper tubular portion and the rotational portion of the fluid moving tool, wherein the rotational power source is one of a power swivel, a top drive drilling rig, and a rotary, wherein the rotational portion and the stationary portion are shaped and configured such that, when the lower tubular portion is at least partially disposed in well fluid, rotation of the upper tubular portion relative to the stationary portion rotates the rotational portion relative to the stationary portion and causes movement of the well fluid such that well fluid flows into the bore of the lower tubular portion, thereby carrying debris from the wellbore into the bore of the lower tubular portion.

10. The system of claim 9, wherein the rotational portion and the stationary portion form a progressive cavity pump.

11. The system of claim 9, further comprising a debris breakup device coupled to a lower end of the lower exterior housing, wherein the lower exterior housing is coupled to the rotational portion such that the lower exterior housing rotates with the rotational portion and the upper exterior housing, and wherein the debris breakup device includes at least one sharpened edge or tooth to break up debris in the wellbore when the upper exterior housing and lower exterior housing are rotated.

12. The system of claim 11, wherein the debris breakup device is selected from the group consisting of a mill, a drill bit, a workover bit, and a rotary shoe.

13. A system for cleaning debris from a wellbore, the system comprising:

a workstring assembly comprising:

an upper tubular portion defining an upper exterior housing of the workstring assembly;

a lower tubular portion defining a lower exterior housing of the workstring assemlby;

a fluid moving tool coupled between the upper and lower tubular portions, the fluid moving tool including a rotational portion and a stationary portion at least partially surrounding the rotational portion, wherein rotation of the upper tubular portion relative to the stationary portion rotates the rotational portion relative to the stationary portion; and a debris chamber disposed in the lower workstring portion and a screen at an end of the debris chamber, the screen configured to allow the passage of well fluid therethrough while restraining the flow of debris such that debris is captured in the debris chamber, wherein the rotational portion and the stationary portion are shaped and configured such that, when the lower tubular portion is at least partially disposed in well fluid, rotation of the upper tubular portion relative to the stationary portion rotates the rotational portion relative to the stationary portion and causes movement of the well fluid such that well fluid flows into the bore of the lower tubular portion, thereby carrying debris from the wellbore into the bore of the lower tubular portion.

14. A system for cleaning debris from a wellbore, the system comprising:

a workstring assembly comprising:

an upper tubular portion defining an upper exterior housing of the workstring assembly;

a lower tubular portion defining a lower exterior housing of the workstring assemlby;

a fluid moving tool coupled between the upper and lower tubular portions, the fluid moving tool including a rotational portion and a stationary portion at least partially surrounding the rotational portion, wherein rotation of the upper tubular portion relative to the stationary portion rotates the rotational portion relative to the stationary portion; and a clutch connected between the rotational portion and the lower tubular portion such that the upper tubular portion can rotate independently of the lower tubular portion, wherein the rotational portion and the stationary portion are shaped and configured such that, when the lower tubular portion is at least partially disposed in well fluid, rotation of the upper tubular portion relative to the stationary portion rotates the rotational portion relative to the stationary portion and causes movement of the well fluid such that well fluid flows into the bore of the lower tubular portion, thereby carrying debris from the wellbore into the bore of the lower tubular portion.

* * * * *